US008733308B2

(12) United States Patent
Racklebe et al.

(10) Patent No.: US 8,733,308 B2
(45) Date of Patent: May 27, 2014

(54) HYDRAULICALLY ACTUATED CAMSHAFT ADJUSTING DEVICE

(75) Inventors: Steffen Racklebe, Obermichelbach (DE); Jochen Auchter, Gerhardshofen (DE); Jochen Broz, Weisendorf (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/640,502

(22) PCT Filed: May 19, 2011

(86) PCT No.: PCT/EP2011/058190

§ 371 (c)(1),
(2), (4) Date: Oct. 11, 2012

(87) PCT Pub. No.: WO2011/147741

PCT Pub. Date: Dec. 1, 2011

(65) Prior Publication Data

US 2013/0025552 A1 Jan. 31, 2013

(30) Foreign Application Priority Data

May 25, 2010 (DE) ..... 10 2010 021 399

(51) Int. Cl.
*F01L 1/34* (2006.01)
*F01L 9/02* (2006.01)
*F01L 1/344* (2006.01)

(52) U.S. Cl.
CPC . *F01L 9/02* (2013.01); *F01L 1/3442* (2013.01)
USPC ..... 123/90.17; 123/90.15; 123/90.12; 464/160

(58) Field of Classification Search
USPC ..... 123/90.12, 90.15, 90.17; 464/160
See application file for complete search history.

(56) References Cited

U.S. PATENT DOCUMENTS 7,281,506 B2 * 10/2007 Maeyama et al. ..... 123/90.17

FOREIGN PATENT DOCUMENTS

| | | |
|---|---|---|
| DE | 4210580 | 10/1993 |
| DE | 102006012733 | 3/2008 |
| DE | 102008004591 | 7/2009 |
| EP | 0924391 | 6/1999 |
| EP | 0924393 | 6/1999 |
| GB | 2217812 | 11/1989 |
| WO | 9323656 | 11/1993 |

* cited by examiner

*Primary Examiner* — Ching Chang
(74) *Attorney, Agent, or Firm* — Volpe and Koenig, P.C.

(57) ABSTRACT

A camshaft adjusting device (1) including at least two hydraulic chamber (A, B) disposed between a stator (3) and a rotor (4) and separated by a vane (5) and supplied with pressure oil from a pressure oil source (P) by a hydraulic oil controller (6). In order to achieve improved filling and emptying of the hydraulic chambers, the hydraulic oil controller according to the invention provides: first and second supply lines (7, 9) disposed between the pressure oil source (P) and one of the hydraulic chambers (A), wherein check valves (8, 10) are disposed in the supply lines (7), wherein the supply lines (7) are free of further switchable valve elements, and wherein the supply lines (7) are the sole inlet line for hydraulic oil from the pressurized oil source (P) into the hydraulic chambers (A, B), and a 4/3-way valve element (11) that is effectively disposed between the hydraulic chambers (A, B) and a tank (T) has three valve positions (I, II, III).

10 Claims, 7 Drawing Sheets

HYDRAULICALLY ACTUATED CAMSHAFT ADJUSTING DEVICE

BACKGROUND

The invention relates to a hydraulically actuated camshaft adjusting device for changing the relative angular position of a camshaft in relation to a crankshaft of an internal combustion engine, wherein the camshaft adjusting device has at least two hydraulic chambers, which are arranged between a stator and rotor and are separated by a vane, and which are supplied with pressurized oil from a pressurized oil source by means of a hydraulic oil control assembly.

Camshaft adjusting devices, in particular those which operate hydraulically, are well known in the prior art. A vane wheel is provided in the hydraulic camshaft adjuster, in which vanes are molded or arranged. The vanes are located in hydraulic chambers which are incorporated in an external rotor (typically referred to as a stator). Through corresponding application of hydraulic fluid to the respective side of the hydraulic chambers, the internal rotor (connected to the camshaft) can be adjusted relative to the stator between an "early stop" and a "late stop".

A generic hydraulically actuated camshaft adjusting device is described in DE 10 2006 012 733 A1. By means of a hydraulic oil control assembly, the adjusting device is supplied with pressurized oil here from a pressurized oil source. The control of the flow of hydraulic oil is performed by a valve element, which is implemented in particular as a 4/3-way proportional valve. Depending on the setting of the proportional valve, a control edge is opened in the inlet and the respective displacer space (hydraulic chamber) is supplied with pressurized oil. Because of the structure of the valve, a second control edge opens, which therefore releases the oil stream from the other displacer space (hydraulic chamber) to the tank.

As a result of the concept of the valves which is typically used, there is a fixed mechanical connection of the mentioned control edges via the control slide (hydraulic piston). Therefore, in particular with high camshaft torques (torque-driven range), it can occur that sufficient filling of the hydraulic chambers with the required volume streams does not occur. At large camshaft torques, because of the high pressure level, more oil can be conveyed from the adjuster into the tank than via the inflow resistances into the adjuster. This volume stream limiting in the inflow results from the pressurized oil supply, the resistance in the engine block, in the cylinder head, and the dominant resistance of the inflow control edge of the proportional valve.

Accordingly, independent filling and emptying of the hydraulic chamber is thus disadvantageously not ensured. In systems having low oil supply pressure and high alternating torque of the valve drive and the camshaft, this sometimes results in a severe undersupply of the inflow to the hydraulic chamber. Gas dissolved in the oil is released and the dissolved air is compressed upon the direction reversal of the alternating torque, and the entire inertia of the adjusting system is accelerated nearly without resistance in this phase. If the air enters solution, upon contact between the vanes of the camshaft adjuster and the oil, the kinetic energy of the adjusting system is converted into pressure energy and pressure spikes arise. These can cause undesired noises and large amplitudes of the oscillation angle, which means a reduction of the system stiffness or can result in mechanical overstrain of the camshaft adjuster.

There is a trend in the context of the always sought-after reduction of consumption and emission in gasoline and diesel engines to decrease the supply pressure and therefore the oil pump performance of the engine. This has already resulted in an altered control edge layout of the proportional valves, which were dethrottled in the inflow. However, the mechanical coupling between inflow resistance and outflow resistance still exists.

SUMMARY

The present invention is based on the objective of refining a camshaft adjuster such that elevated adjustment speeds of the camshaft adjuster are possible with identical pressurized oil supply or an identical adjustment speed is possible with a reduced pressurized oil supply. Furthermore, an elevated system stiffness is sought, so that smaller amplitudes of the adjustment angle are possible. In particular, the formation of gas bubbles caused by partial vacuum in the hydraulic oil is to be prevented. In this way and due to the higher system stiffness, the oscillation amplitudes are to be decreased in the case of occurring oscillations. The mechanical strain of the components of the camshaft adjuster is therefore to be reduced and the system behavior is thus to be improved.

This objective is met by the invention characterized in that the hydraulic control assembly of the camshaft adjuster has:

- a first supply line, which is arranged between the pressurized oil source and a first hydraulic chamber, wherein a check valve is arranged in the first supply line, which permits the flow of hydraulic oil from the pressurized oil source into the hydraulic chamber and prevents it in the opposite direction, wherein the first supply line is free of further switchable valve elements and wherein the first supply line is the only feed line for hydraulic oil from the pressurized oil source into the hydraulic chamber,
- a second supply line, which is arranged between the pressurized oil source and a second hydraulic chamber, wherein a check valve is arranged in the second supply line, which permits the flow of hydraulic oil from the pressurized oil source into the hydraulic chamber and prevents it in the opposite direction, wherein the second supply line is free of further switchable valve elements and wherein the second supply line is the only feed line for hydraulic oil from the pressurized oil source into the hydraulic chamber,
- a valve element, which is arranged to act between the hydraulic chambers and a tank and has three valve positions, as follows
  - a) a first valve position, in which the drainage of hydraulic oil from the two hydraulic chambers into the tank is interrupted,
  - b) a second valve position, in which the drainage of hydraulic oil from the first hydraulic chamber to the tank is released and the drainage of hydraulic oil from the second hydraulic chamber to the tank is interrupted, and
  - c) a third valve position, in which the drainage of hydraulic oil from the second hydraulic chamber to the tank is released and the drainage of hydraulic oil from the first hydraulic chamber to the tank is interrupted.

The valve element typically comprises a hydraulic piston for setting the valve positions, which can be displaced by an actuating element in a translational displacement direction. The actuating element is preferably an electromagnet.

The check valves in the first and second supply lines can be integrated directly in the hydraulic piston. An alternative provides that the check valves are arranged outside the hydraulic piston.

The check valves in the first and second supply lines can be implemented as spring-preloaded ball check valves, as band check valves or as flap valves.

The valve element is preferably implemented as a central screw. In this case, it is preferably provided that the valve element is arranged having a threaded section in a threaded bore in the camshaft of the internal combustion engine.

It is accordingly provided according to the invention that a modified 4/3-way proportional valve is used, wherein the fixed mechanical connection of the control edges via the control slide, which has been provided up to this point, is not provided. The modification of the hydraulic circuit provided in comparison to previously known solutions thus goes beyond resolving the mechanically rigid connection of the (inflow) control edges.

The inflow-side control edges (from the pressurized oil source P into the hydraulic chamber A and from the pressurized oil source P into the hydraulic chamber B) are not implemented via the control slide (hydraulic piston), but rather independently by two check valves (which represent a logic element circuit). Only the connections from the hydraulic chamber A to the tank T and from the hydraulic chamber B to the tank T are changed by the position of the control slide.

The proposed embodiment of a camshaft adjuster allows the operation thereof with elevated adjustment speeds with identical pressurized oil supply or identical adjustment speed with reduced pressurized oil supply. Smaller amplitudes of the adjustment angle can thus be achieved by an elevated system stiffness.

Is therefore advantageous that elevated adjustment speed and reduced oscillation behavior are achievable. The adjuster can therefore be used particularly well in applications in which a high speeds are controlled via a valve, at which high forces or torques arise at low supply pressure.

In comparison to previously known solutions, lower manufacturing costs can be implemented, since the complex manufacturing of two control edges of the hydraulic piston is not necessary. Otherwise, only slight changes are required to the existing structure of the camshaft adjuster, in order to implement the invention. Integration in existing embodiments is possible with identical installation space.

The proposed modification of a 4/3-way proportional valve allows a gas bubble caused by partial vacuum to be able to be prevented as a result of the separation of the mechanical connection of the inflow control edge and the outflow control edge of the hydraulic piston. The avoidance of gas bubbles increases the stiffness of the system.

BRIEF DESCRIPTION OF THE DRAWINGS

Exemplary embodiments of the invention are illustrated in the drawings. In the figures.

DETAILED DESCRIPTION OF THE PREFERRED EMBODIMENTS

Figure 1:
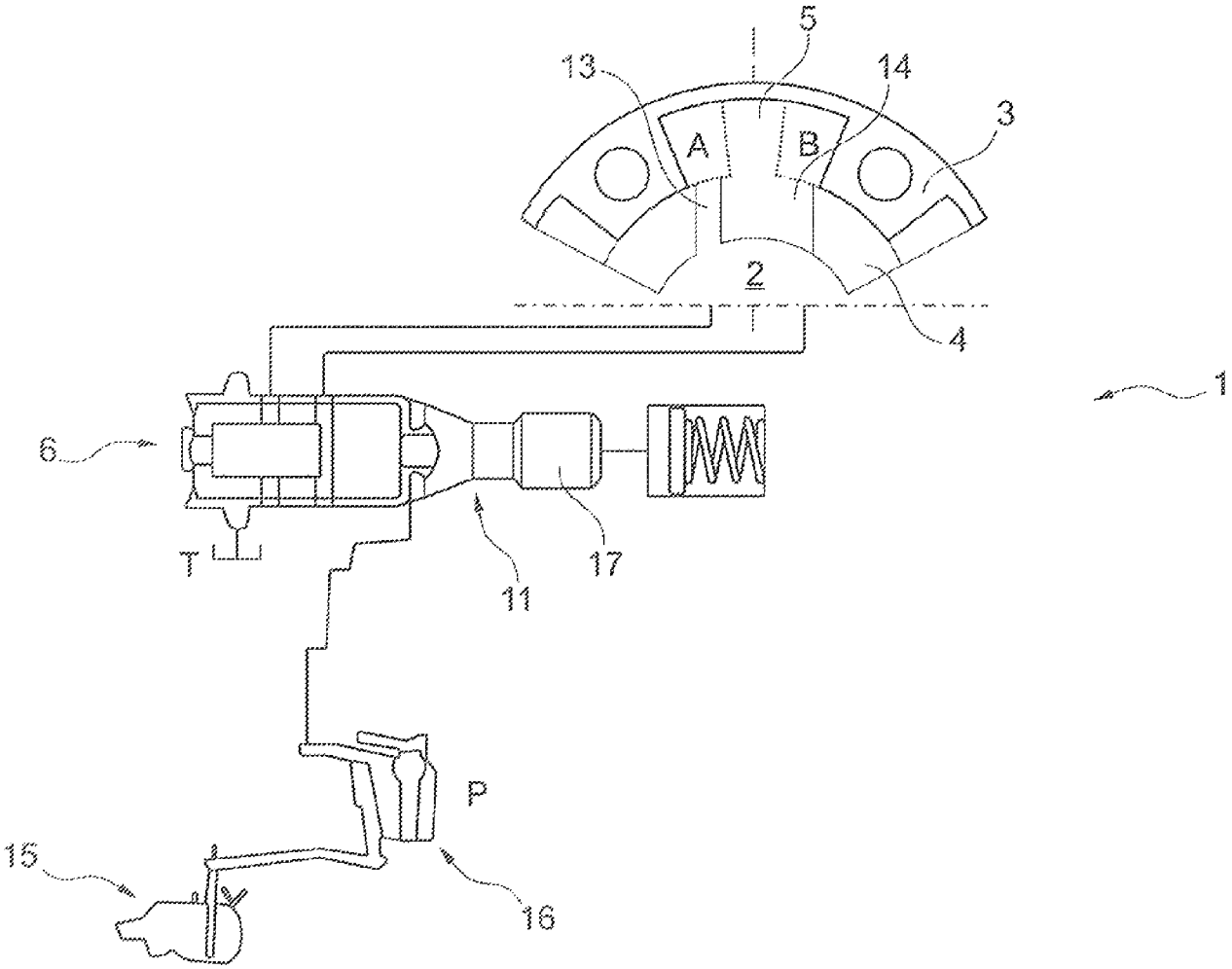
FIG. 1 schematically shows the structure of a camshaft adjuster for changing the relative angular position of a camshaft in relation to a crankshaft of an internal combustion engine, FIG. 2 schematically shows a valve element for the camshaft adjuster according to FIG. 1 according to the prior art, FIG. 3 schematically shows a valve element for the camshaft adjuster according to the invention, FIG. 4*a* to FIG. 4*c* schematically show the valve element with several structural details according to a first embodiment of the invention, FIG. 5*a* to FIG. 5*c* schematically show the valve element with several structural details according to a second embodiment of the invention, FIG. 6*a* to FIG. 6*c* schematically show the valve element with several structural details according to a third embodiment of the invention, FIG. 7*a* to FIG. 7*c* schematically show the valve element with several structural details according to a fourth embodiment of the invention.

A camshaft adjusting device 1 is schematically outlined in FIG. 1, through the use of which a camshaft 2 (only suggested) can be set in relation to a crankshaft (not shown) of an internal combustion engine in a way known per se with respect to the relative rotational position. Reference is expressly made to DE 10 2008 004 591 A1 of the applicant with respect to details; the operating principle of a hydraulic camshaft adjuster is comprehensively described in this document, so that it does not have to be discussed in greater detail here.

The camshaft adjusting device 1 comprises a stator 3 (connected rotationally-fixed to the crankshaft of the internal combustion engine) and a rotor 4 (connected rotationally-fixed to the camshaft 2), wherein a rotational adjustment can occur between stator 3 and rotor 4, for which a hydraulic drive is used. This hydraulic drive comprises two hydraulic chambers A and B, which are divided by a vane 5, which is molded onto the rotor 4. Accordingly, a relative rotational adjustment occurs between stator 3 and rotor 4 when pressurized oil is fed or discharged via corresponding inflow lines 13 or 14, respectively. The controlled feed or discharge of pressurized oil into the hydraulic chambers A or B is caused by a hydraulic oil control assembly 6. Oil is thereby conducted from a pressurized oil source P into the hydraulic chambers A, B or discharged from the chambers A, B back into a tank T. A pump 15 provides the pressurized oil via a filter 16.

The core element of the hydraulic oil control assembly 6 is a valve element 11, which can be implemented as a central valve; in this case, the valve element 11 is seated having a threaded section 17 in a centrally arranged threaded bore in the camshaft 2. Details on the construction and operating principle of a camshaft adjuster 1 and in particular the valve element 11 are described in cited DE 10 2008 004 591 A1 of the applicant, to which reference is hereby expressly made.

Figure 2:
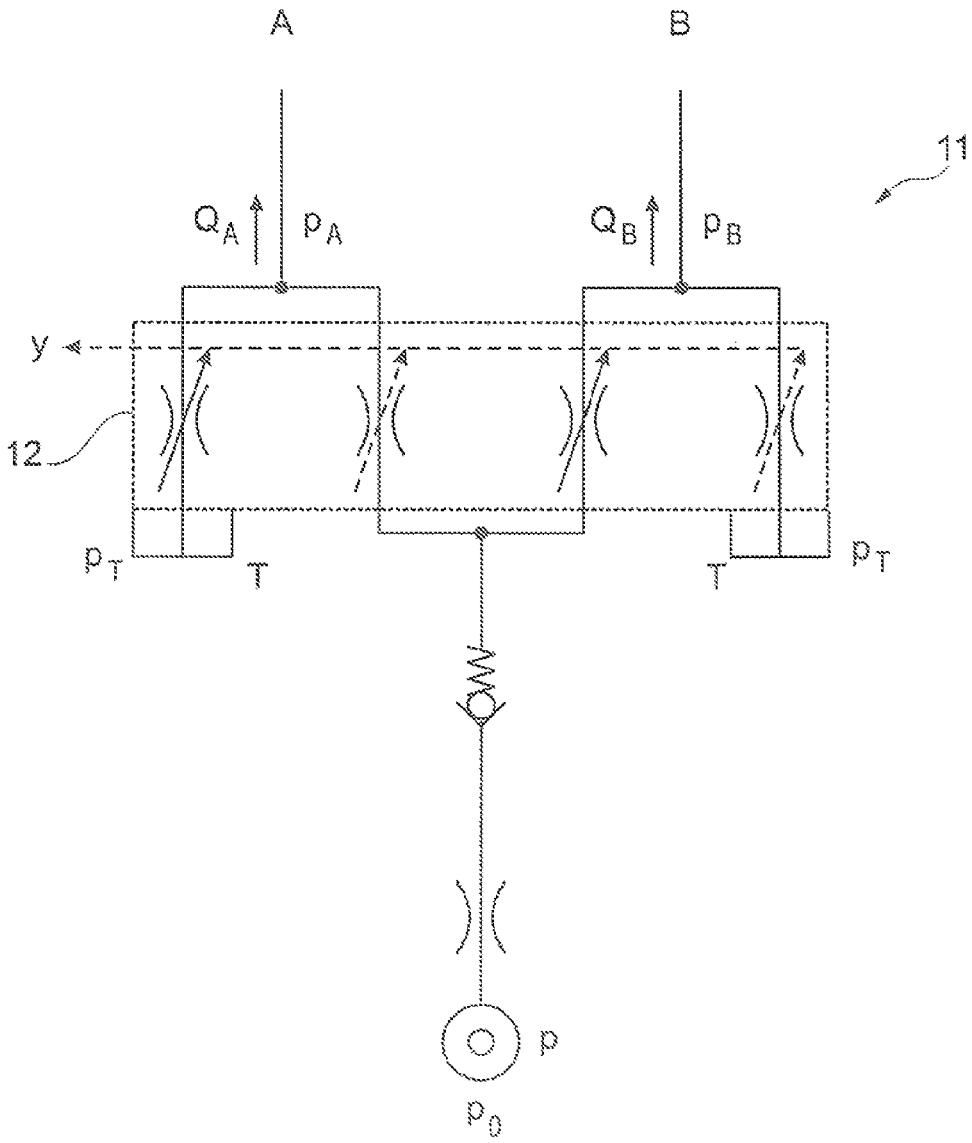
Fig. 2 Prior Art

FIG. 2 shows a previously known embodiment of the valve element 11. The pressurized oil arrives from the pressurized oil source P at a pressure $p_0$ in the valve element 11, which is implemented as a 4/3-way proportional valve. A hydraulic piston 12 is moved by an electromagnetic actuator in the direction of a translational displacement direction y and the oil control is thus performed in a known manner. No oil reaches the hydraulic chambers A and B or leaves therefrom in this case in a first valve position. In a second position, oil is conveyed with a volume stream $Q_A$ and a pressure $p_A$ into the chamber A, wherein oil can simultaneously drain out of the chamber B into the tank T, where the slight ambient pressure $p_T$ prevails. In a third position, oil is conveyed with a volume stream $Q_B$ and a pressure $p_B$ into the chamber B, wherein oil can simultaneously drain out of the chamber A into the tank T. The control edges of the hydraulic piston 12 are thereby all mechanically coupled or connected, i.e., the inflow and outflow are mechanically connected via the movement of the hydraulic piston 12 (in the direction y). The open valves are marked as examples by solid arrows, and the closed valves are marked by dashed arrows.

In relation to this previously known solution, the invention provides according to FIG. 3 that the hydraulic oil control assembly 6 is constructed as follows:

Firstly, a first supply line 7 is provided, which is arranged between the pressurized oil source P and the hydraulic chamber A. A check valve 8 is arranged in this first supply line 7. This permits the flow of hydraulic oil from the pressurized oil source P into the hydraulic chamber A, no oil can flow in the opposite direction, however. The first supply line 7 is free of further switchable valve elements in this case. The first supply line 7 is also the only feed line with which oil can reach the hydraulic chamber A from the pressurized oil source P. Oil flows when the pressure of the pressurized oil source P is higher than the pressure in the chamber A.

A second supply line 9 is then provided in a similar manner, which is arranged between the pressurized oil source P and a hydraulic chamber B. A check valve 10 is in the second supply line 9. Hydraulic oil can therefore again flow from the pressurized oil source P into the hydraulic chamber B, but not in the opposite direction. The second supply line 9 is free of further switchable valve elements; the line 9 is also the only feed line for oil from the pressurized oil source P into the hydraulic chamber. Oil flows when the pressure of the pressurized oil source P is higher than the pressure in the chamber B.

Figure 3:
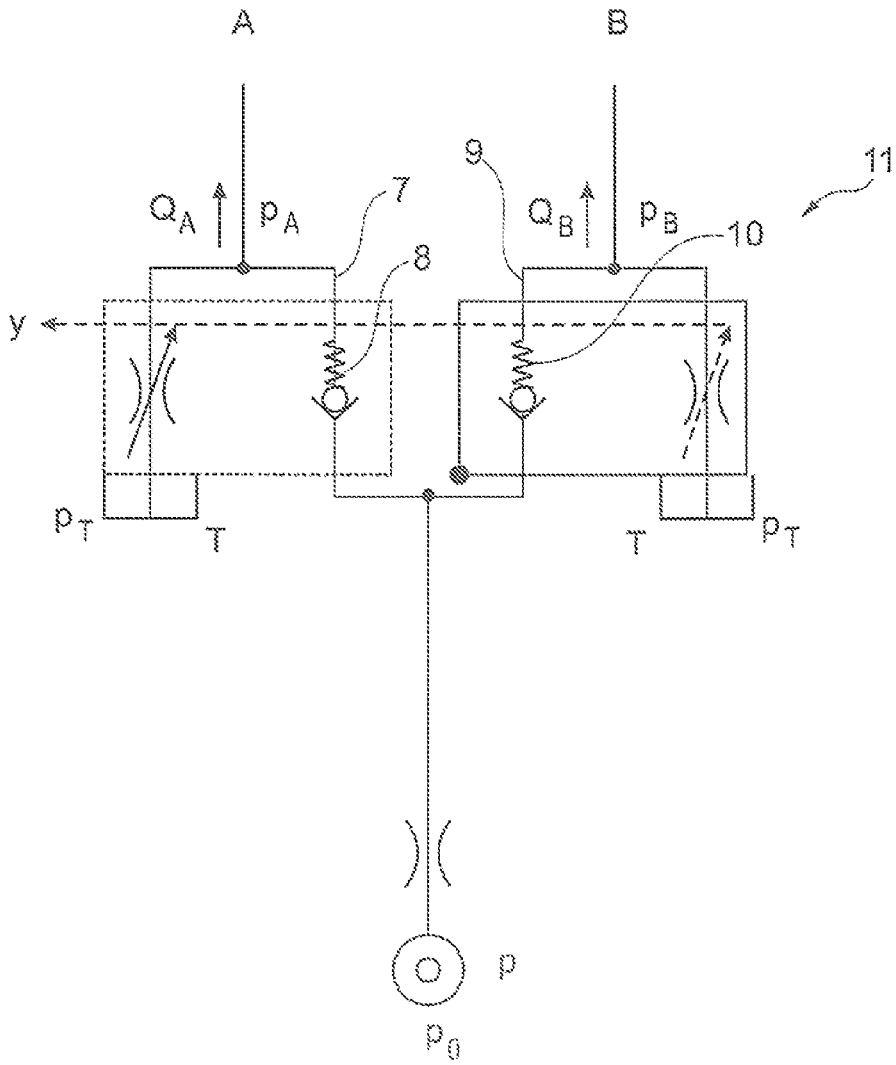

The open valve is marked as an example by a solid arrow in FIG. 3, and the closed valve is marked by a dashed arrow.

The inflow control is thus performed via a hydraulic logic circuit, which the two check valves 8 and 10 form.

The inflow and outflow are now decoupled from one another; the inflow into the chambers A, B is particularly no longer dependent on the position of the hydraulic piston 12 (in the direction y).

The valve element 11, which is arranged to act between the hydraulic chambers A, B and the tank, can have three valve positions:

In a first valve position (I, see FIGS. 4 to 7), the drainage of hydraulic oil from the two hydraulic chambers A, B into the tank T is interrupted.

In a second valve position (II, see FIGS. 4 to 7), hydraulic oil can drain from the first hydraulic chamber A to the tank T; the drainage of hydraulic oil from the second hydraulic chamber B to the tank T is, however, interrupted.

In a third valve position (III, see FIGS. 4 to 7), the drainage of hydraulic oil from the second hydraulic chamber B to the tank T is released; however, the drainage of hydraulic oil from the first hydraulic chamber A to the tank T is interrupted.

FIGS. 4 to 7 show constructive outlines of this fundamental embodiment in each case for the three mentioned valve positions I, II and III.

Figure 4A:
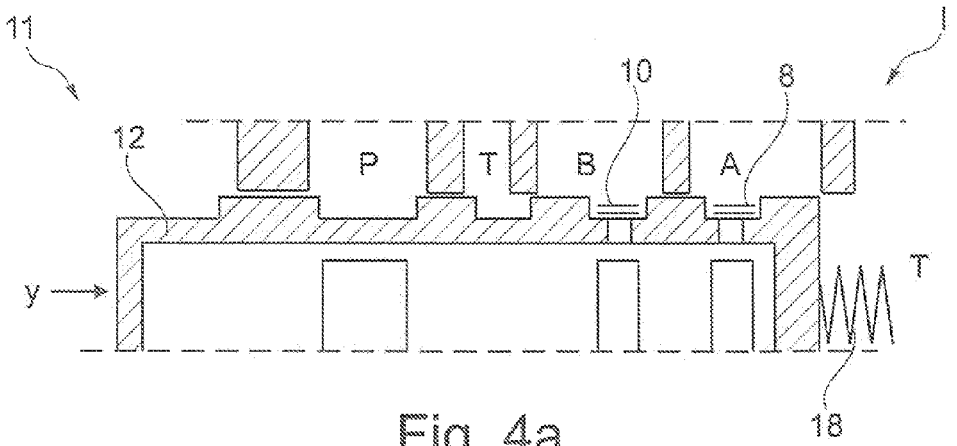
Figure 4B:
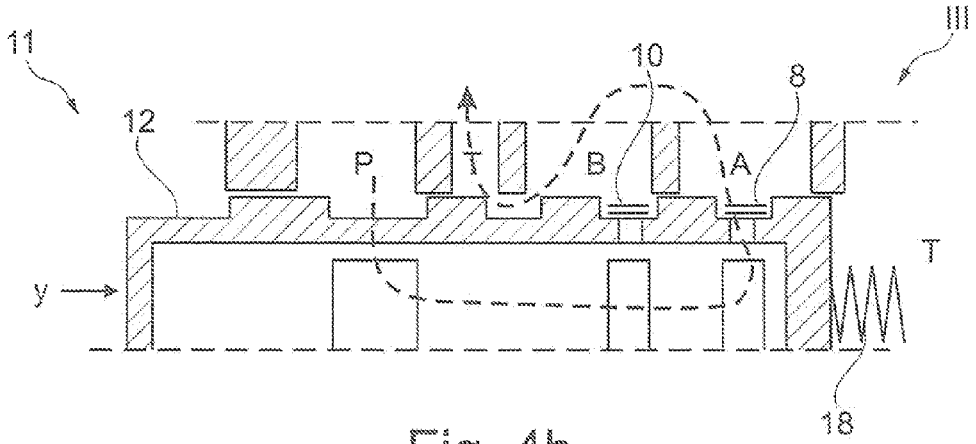
Figure 4C:
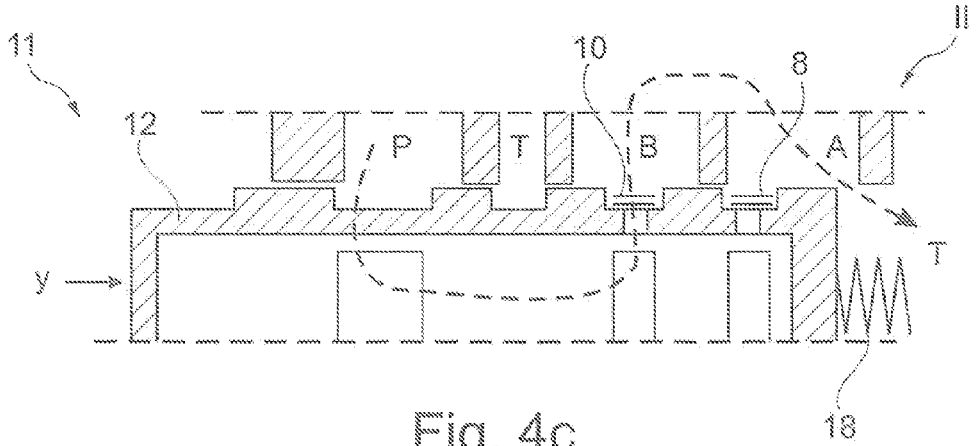

FIG. 4*a*, FIG. 4*b*, and FIG. 4*c* show that the check valves 8 and 10 are implemented as band check valves (an external spiral band in the form of a sheet metal or plastic spring encloses the bore in the hydraulic piston), wherein they are integrated in the hydraulic piston 12. The hydraulic piston 12 is located as an element displaceable translationally in the direction y in a valve housing and is axially pre-tensioned against an electromagnetic actuator by a spring 18.

While the fluidic connection between the pressurized oil source P via the check valves 8 and 10 to the hydraulic chambers A, B always exists, the control edges of the hydraulic piston 12 have the effect that in the valve position I according to FIG. 4*a*, no oil can drain from the chambers A, B into the tank T.

If the hydraulic piston 12 is moved somewhat further to the right in relation to the housing of the valve element into the valve position III (see comparison of FIGS. 4*a* and 4*b*), a drainage possibility is provided for oil from the chamber B into the tank T; since the fluidic connection between the pressurized oil source P and the chamber A via the check valve 8 continuously exists, oil can therefore flow into the chamber A, while oil can simultaneously drain out of the chamber B into the tank T (see dashed line in FIG. 4*b*). A backflow of oil from the chamber B to the pressurized oil source P is prevented by the closed check valve 10.

However, if the hydraulic piston 12—compared to the position according to FIG. 4*a*—is moved somewhat to the left relative to the valve housing, i.e., into the valve position II, as shown in FIG. 4*c*, the reverse picture results: oil can now drain from the chamber A into the tank T; oil continues to flow into the chamber B via the continuous connection between the pressurized oil source P and the chamber B, in which the check valve 10 is arranged, and accordingly flows from the chamber A into the tank T (see dashed line in FIG. 4*c*). A backflow of oil from the chamber A to the pressurized oil source P is prevented by the closed check valve 8.

Figure 5A:
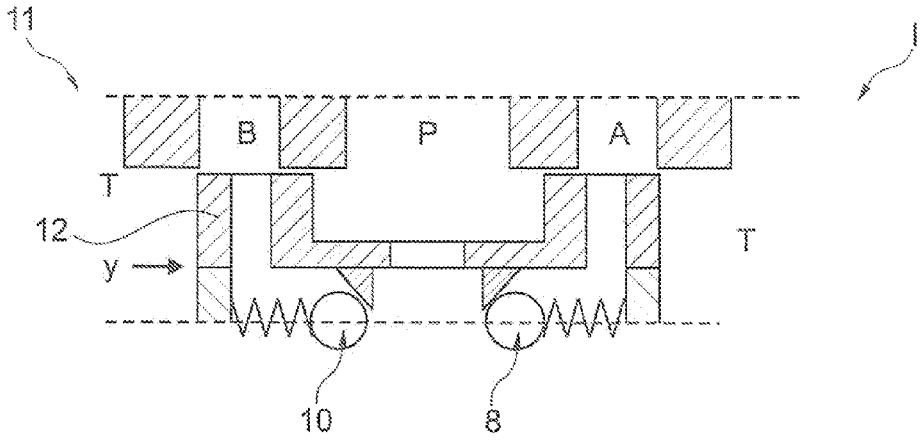
Figure 5B:
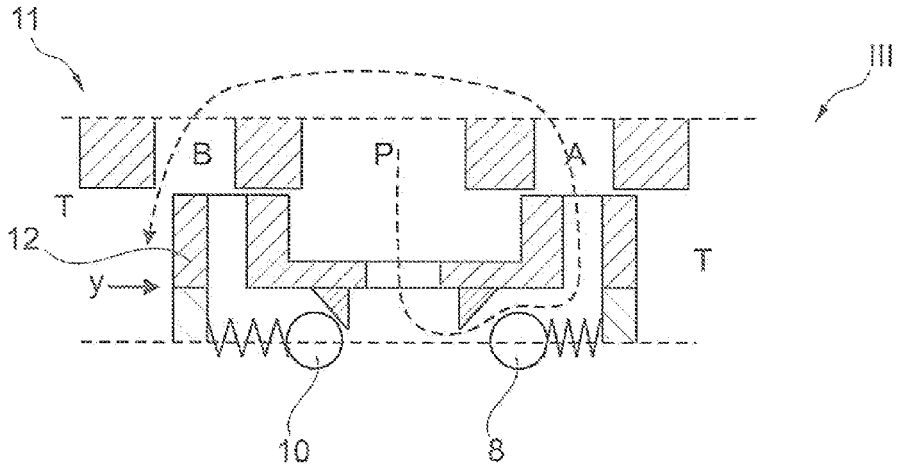
Figure 5C:
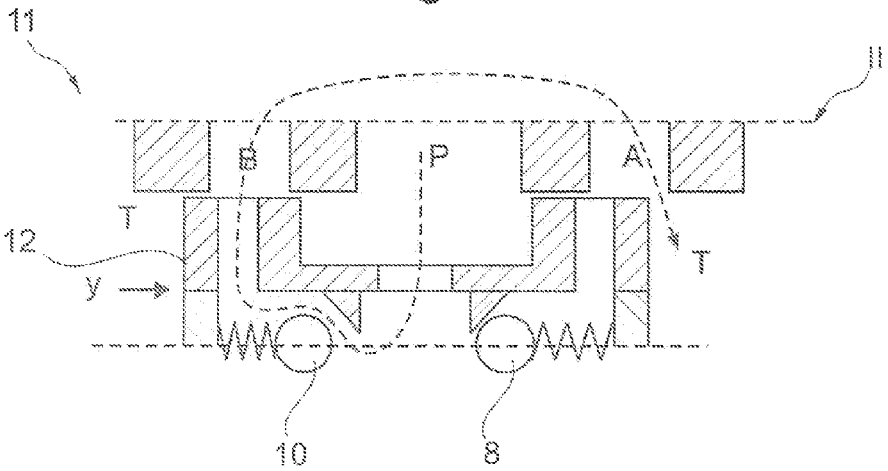

A similar embodiment of the valve element 11 is schematically outlined in FIGS. 5*a*, 5*b*, and 5*c*, wherein spring-preloaded ball check valves are used here instead of the band check valves. The operating principle is precisely as described in conjunction with FIG. 4, however.

For both solutions—i.e., according to FIG. 4 and according to FIG. 5—the check valves 8 and 10 are integrated in the hydraulic piston 12.

Figure 6A:
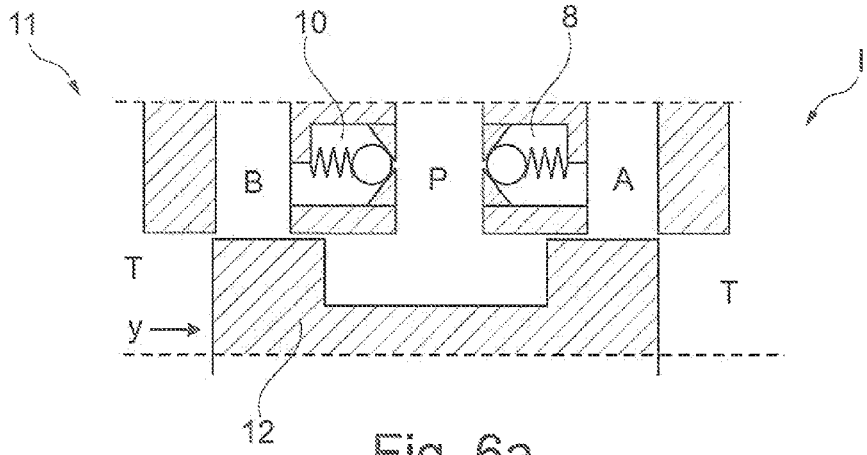
Figure 6B:
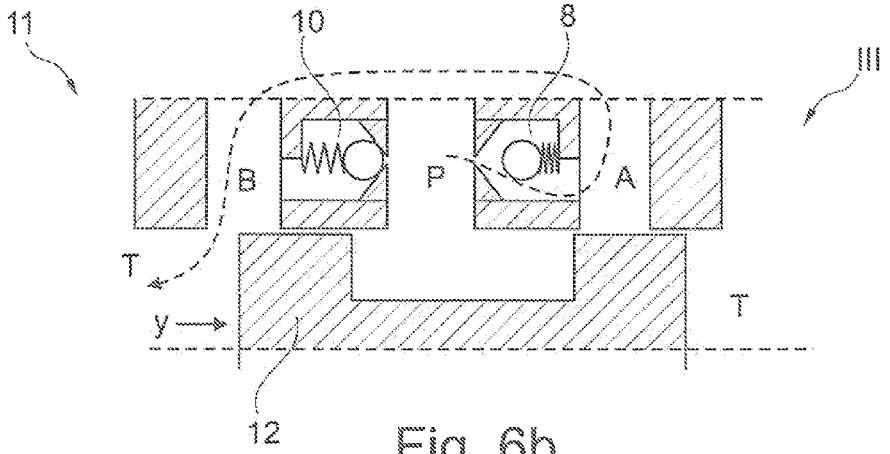
Figure 6C:
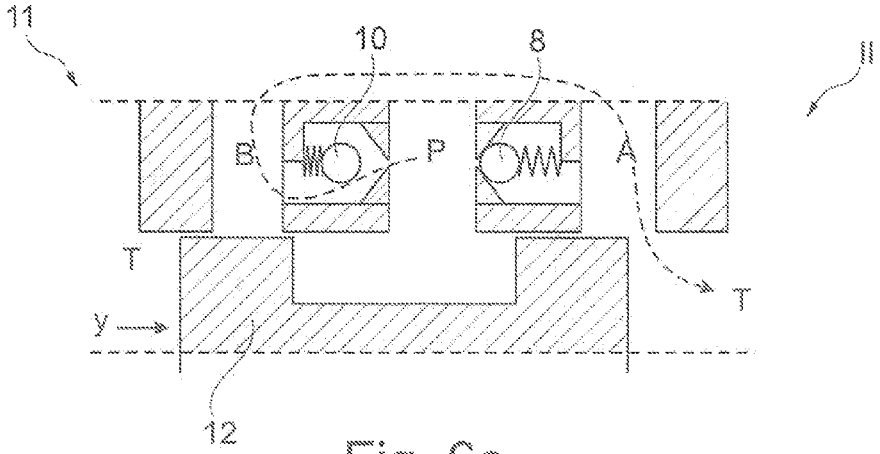
Figure 7A:
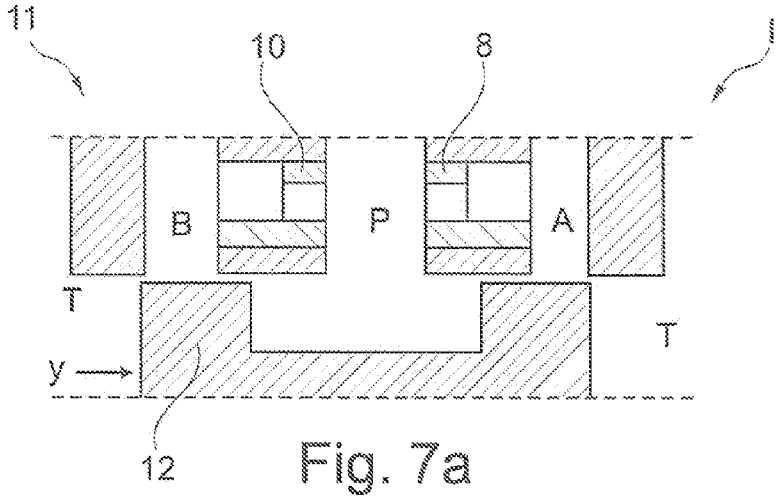
Figure 7B:
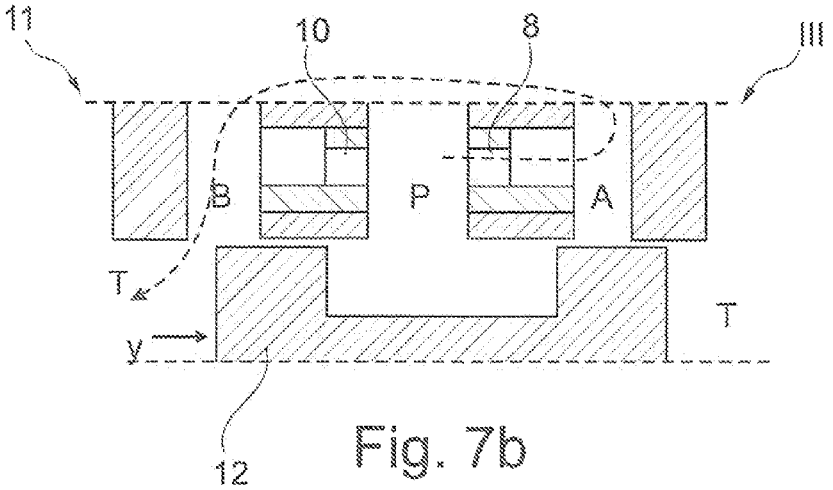
Figure 7C:
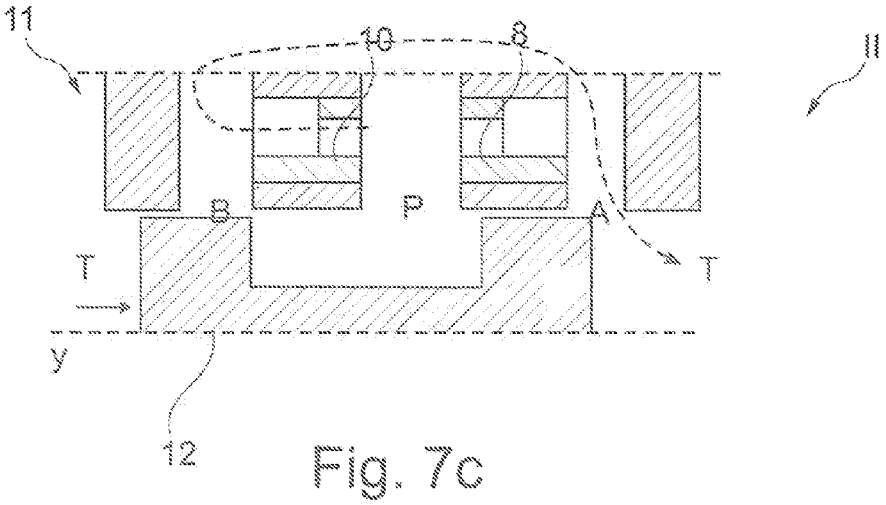

However, this does not necessarily have to be the case. FIGS. 6 and 7 show further alternative embodiments of the proposed valve element 11, wherein the check valves 8 and 10 are arranged outside the hydraulic piston 12 here. FIG. 6 again provides spring-preloaded ball check valves 8, 10, while FIG. 7 uses flap check valves 8, 10.

The speed of the system is set by means of the resistances in the outflow of the oil from the hydraulic chambers A, B.

Accordingly, using the proposed solution, a decoupling of the inflow of oil from the pressure source P into the chambers A and B from the outflow control edge from the chambers A or B, respectively, into the tank T can be achieved. The advantage of this concept is above all sufficient filling of the chambers A, B, whereby the outgassing of the air dissolved in the oil is substantially avoided. Therefore, both the oscillation behavior and also the noise behavior of the camshaft adjuster are positively influenced.

The proposed solution can be used both in the pressure-driven range and also in the torque-driven range (i.e., at high camshaft torques).

The filling of the hydraulic chambers A, B thus occurs independently of the position of the hydraulic piston 12 in the valve housing, solely through the pressure relationships between the pressurized oil source and the chambers A, B.

LIST OF REFERENCE NUMERALS

1 camshaft adjusting device
2 camshaft
3 stator
4 rotor
5 vane
6 hydraulic oil control assembly
7 first supply line
8 check valve
9 second supply line
10 check valve
11 valve element
12 hydraulic piston
13 inflow line

14 inflow line
15 pump
16 filter
17 threaded section
18 spring
A hydraulic chamber
B hydraulic chamber
P pressurized oil source
T tank
I valve position
II valve position
III valve position
y displacement direction

The invention claimed is:

1. A hydraulically actuated camshaft adjusting device for changing a relative angular position of a camshaft in relation to a crankshaft of an internal combustion engine, the camshaft adjusting device comprising at least first and second hydraulic chambers (A, B), which are arranged between a stator and a rotor and are separated by a vane, and which are supplied with pressurized oil from a pressurized oil source (P) by a hydraulic oil control assembly, the hydraulic oil control assembly includes:

a first supply line, which is arranged between the pressurized oil source (P) and the first hydraulic chamber (A), a first check valve is arranged in the first supply line, which permits a flow of hydraulic oil from the pressurized oil source (P) into the first hydraulic chamber (A) and prevents the flow in an opposite direction, wherein the first supply line is free of further switchable valve elements, and the first supply line is the only feed line for hydraulic oil from the pressurized oil source (P) into the first hydraulic chamber (A), a second supply line, which is arranged between the pressurized oil source (P) and the second hydraulic chamber (B), a second check valve is arranged in the second supply line, which permits a flow of hydraulic oil from the pressurized oil source (P) into the second hydraulic chamber (B) and prevents the flow in an opposite direction, the second supply line is free of further switchable valve elements and the second supply line is the only feed line for hydraulic oil from the pressurized oil source (P) into the second hydraulic chamber (B), a valve element, which is arranged to act between the hydraulic chambers (A, B) and a tank (T) and has first, second, and third valve positions (I, II, III), as follows:

a) the first valve position (I), in which drainage of hydraulic oil from the first and second hydraulic chambers (A, B) into the tank (T) is interrupted, b) the second valve position (II), in which drainage of hydraulic oil from the first hydraulic chamber (A) to the tank (T) is released and drainage of hydraulic oil from the second hydraulic chamber (B) to the tank (T) is interrupted, and c) the third valve position (III), in which drainage of hydraulic oil from the second hydraulic chamber (B) to the tank (T) is released and drainage of hydraulic oil from the first hydraulic chamber (A) to the tank (T) is interrupted.

2. The camshaft adjusting device as claimed in claim 1, wherein the valve element comprises a hydraulic piston for setting the valve positions (I, II, III), which can be displaced by an actuating element in a translational displacement direction (y).

3. The camshaft adjusting device as claimed in claim 2, wherein the actuating element comprises an electromagnet.

4. The camshaft adjusting device as claimed in claim 2, wherein the check valves in the first and second supply lines are integrated in the hydraulic piston.

5. The camshaft adjusting device as claimed in claim 2, wherein the check valves in the first and second supply lines are arranged outside the hydraulic piston.

6. The camshaft adjusting device as claimed in claim 1, wherein the check valves in the first and second supply lines are spring-preloaded ball check valves.

7. The camshaft adjusting device as claimed in claim 1, wherein the check valves in the first and second supply lines are band check valves.

8. The camshaft adjusting device as claimed in claim 1, wherein the check valves in the first and second supply lines are flap valves.

9. The camshaft adjusting device as claimed in claim 1, wherein the valve element is provided in a central screw.

10. The camshaft adjusting device as claimed in claim 9, wherein the valve element is arranged having a threaded section in a threaded bore in the camshaft of the internal combustion engine.

* * * * *